United States Patent [19]

Berthin

[11] 4,448,570

[45] May 15, 1984

[54] METHOD OF CONSTRUCTING A CONCRETE OFF-SHORE STRUCTURE MORE THAN 200 M HIGH STABILIZED ON THE SEA BED BY ITS OWN WEIGHT

[75] Inventor: Jean-Claude Berthin, Mennecy, France

[73] Assignee: Sea Tank Co., Rungis, France

[21] Appl. No.: 304,498

[22] Filed: Sep. 22, 1981

[30] Foreign Application Priority Data

Oct. 21, 1980 [FR] France ..... 80 22443

[51] Int. Cl.[3] ..... E02B 17/00

[52] U.S. Cl. ..... 405/204; 52/227; 405/207; 405/222

[58] Field of Search ..... 405/195, 203–209, 405/222; 52/227, 726

[56] References Cited

U.S. PATENT DOCUMENTS

| | | | |
|---|---|---|---|
| 782,557 | 2/1905 | Hadlock et al. | 405/207 |
| 2,750,750 | 6/1956 | Kuss . | |
| 3,859,806 | 1/1975 | Guy . | |
| 3,892,096 | 7/1975 | Macchi | 52/227 |

FOREIGN PATENT DOCUMENTS

| | | | |
|---|---|---|---|
| 2909175 | 9/1980 | Fed. Rep. of Germany | 405/204 |
| 2253379 | 6/1975 | France . | |
| 2300847 | 10/1976 | France . | |

OTHER PUBLICATIONS

2114 L'Industrie du Petrole vol. 46, No. 490, (1978-01/02), "Du Reservoir Sous-Marin Au Sous-Marin Reservoir", by L. P. Huvale.

*Primary Examiner*—David H. Corbin

*Attorney, Agent, or Firm*—Sughrue, Mion, Zinn, Macpeak & Seas

[57] ABSTRACT

The structure is made in several "storeys" (D1, D2, D3). These are floated away from their construction site in conventional manner. Once in sufficiently deep water, the storeys are tilted over so that they float on their side, and they are then joined together end-to-end. With tilting and rotating operations performed by suitable ballasting and unballasting of compartments in the storeys, the joining operations can all be performed on members at or near (just above or just below) the surface of the water. Once the storeys are assembled together, the entire structure may be towed on its side to a point of use, and then immersed so that it stands vertically on the sea bed.

2 Claims, 23 Drawing Figures

METHOD OF CONSTRUCTING A CONCRETE OFF-SHORE STRUCTURE MORE THAN 200 M HIGH STABILIZED ON THE SEA BED BY ITS OWN WEIGHT

FIELD OF THE INVENTION

This invention relates to a method of constructing a concrete off-shore structure which is stabilized on the sea bed by its own weight.

BACKGROUND OF THE INVENTION

Such structures are sometimes referred to as "gravity structures", and they are used to support off-shore working platforms some 20 m above the surface of the water in depths of 200 m to 350 m, for example. The structures are generally used for housing apparatus for exploring and/or exploiting off-shore oil fields. The plan of a typical platform is a square or an equilateral triangle with a side of about 150 m. Under such circumstances, the structure supports it by means of 4 or 3 hollow columns disposed at the corners of the square or triangle. Generally the bottoms of the columns are interconnected by a base unit comprising a plurality of watertight compartments, or "caissons", resting on the sea bed.

Constructing such a structure in concrete is very different from constructing one in metal, since metal members are much lighter. Concrete structures are constructed in the following sequence of operations: prefabrication at a sheltered site, floating, towing to a point vertically above the end site, and finally sinking so that the base comes to rest on the sea floor. The floating and sinking operations are performed by filling and emptying the columns and compartments in the base by means of pumps and valves controlling the flow of compressed air or sea water.

Up to now, large-scale concrete off-shore structures have been built in the vertical position, and kept in that position during the operations of towing to their destination site, initial immersion, and final sinking.

Once the structure is finally resting on the bottom, the working platform is built above the water on the tops of the columns.

The greater the depth at which a gravity structure is to be used, the larger the construction site required by the above-described method for prefabrication, and the more powerful and expensive the lifting equipment needed. The generally held view of specialists in this form of construction is that it is not economically feasible for depths of more than about 200 meters. Great depths lead to the structure being very large and very heavy, e.g.:

- displacement mass of 400,000 to 500,000 tons for structures in the 350 m range; and
- columns with an outside diameter of 25 m at the bottom levels.

Reference can be made to an article on this subject by Jacques BOSIO appearing in the Apr. 12, 1979 issue of the journal "Pétrole Informations", and in particular to FIG. 3 thereof.

The aim of the present invention is to facilitate the construction of a rigid structure for supporting a working platform above the sea in depths of about 200 to about 600 meters, and to make it possible to transport the structure through much shallower waters.

SUMMARY OF THE INVENTION

The present invention provides a method of constructing an off-shore concrete support structure that stands on the sea floor in depths of more than 200 m and is stabilized thereon by its own weight. The method comprises the following steps:

- prefabricating a floating unit comprising a compartmented base with hollow columns projecting upwardly therefrom, said floating unit being prefabricated at a sheltered site by the sea;
- transporting said floating unit to a final site at sea; and
- sinking the unit over its final site by progressively filling the compartments and the columns with water, to cause the base to rest on the sea floor. The improvement involves, in the prefabrication step, constructing a succession of units each constituting one storey of the support structure, the succession including at least a bottom storey and a top storey, and each storey comprising a horizontal polygonal compartmented base with vertical hollow columns of equal height disposed at the corners of the base polygon; and the floating and transporting steps comprise floating each of the storeys at the prefabrication site;
- transporting each storey to an assembly site;
- tilting each of the storeys at the assembly site by progressively filling compartments in the base to cause the storey to float with two of its columns at the surface of the water;
- assembling the storeys with corresponding columns of successive storeys being aligned, and with the base of each upper storey being assembled to the tops of the columns of the next storey down;
- transporting the structure thus assembled in the horizontal position from the assembly site to the final site
- and tilting the assembled structure to bring it into the vertical before said step of sinking it.

BRIEF DESCRIPTION OF THE DRAWINGS

An implementation of the invention is described by way of example with reference to the diagrammatic figures of the accompanying drawings. It will be understood that the details described and shown could be replaced by others having the same technical functions as defined by the claims without thereby going beyond the scope of the invention. When an item appears in more than one figure, it is designated by the same reference in each of them.

DESCRIPTION OF PREFERRED IMPLEMENTATION

The structure described is intended to support a working platform P at a height of 20 meters above the surface of water that is 300 meters deep. It is built up from three storeys (D1, D2, D3) each comprising a base E in the form of a horizontal equilateral triangle with three vertical columns KA, KB, KC projecting upwardly from the corners of the triangle. The reference letters of the various members of each storey are hereafter followed by a number designating the storey in question. For example, the base E1 is the base of the bottom storey standing on the sea floor, and the columns KA3, KB3 and KC3 are the columns of the top storey supporting the platform P. By way of example, the columns may have a wall thickness of 0.70 meters and be 20 meters in diameter at the bottom of the structure tapering to 11 meters in diameter at the top. Each base is constituted by three blocks, VA, VB, VC disposed at the corners of the triangle and interconnected by three arms WA, WB, WC.

All the above-mentioned members comprise a honeycomb structure of watertight compartments made of reinforced prestressed concrete. They are provided with valves to enable water and compressed air to be introduced therein or removed therefrom. The drawings only show a few of the longitudinal prestress cables in one of the sets of superposed columns KA. The cables shown comprise both storey prestress cables such as SA1, SA2 and SA3 each of which extends over nearly the entire height of the storey between a pair of anchor points, and interconnection cables such as TA12 and TA23 extending longitudinally between storeys with their ends extending beyond the the ends of the storey cables, whereby continuous prestressing is provided over the entire height of the structure. Naturally, the strength of each storey, and of the interconnection between adjacent storeys, is assured by using many more cables than are shown, these cables being evenly disposed in the concrete walls, all round the axis of each column.

The method in accordance with the invention includes the following steps known in the prior art:

prefabricating a floating unit comprising a compartmented base with hollow columns projecting upwardly therefrom, said floating unit being prefabricated at a sheltered site by the sea;

transporting said floating unit to an assembly site at sea, the columns being vertical during transport; and sinking the unit over its final site by progressively filling the compartments and the columns with water, to cause the base to rest on the sea floor.

Figure 11:
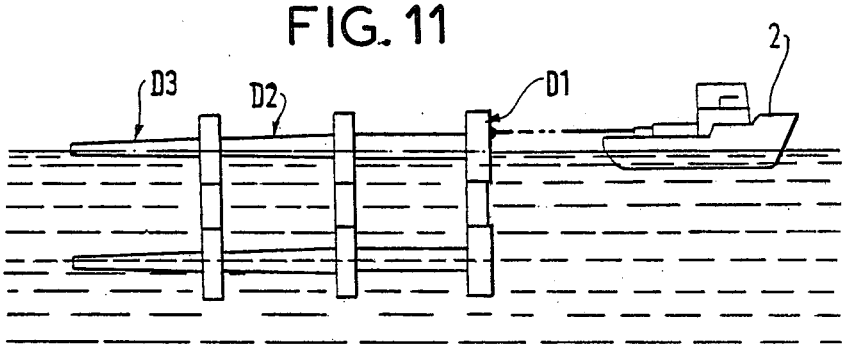
Figure 13:
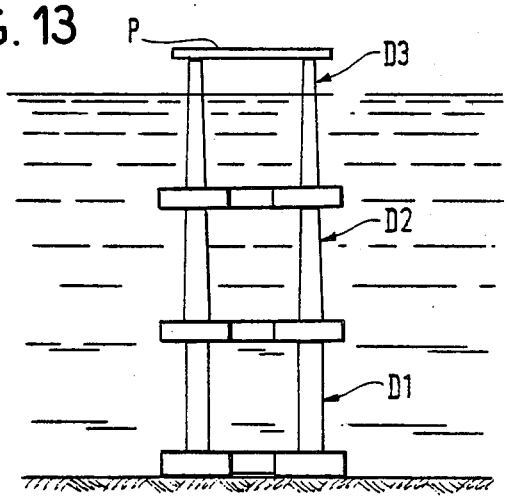

The transport step is shown in FIG. 11 where the structure in being towed by a tug (2). The sinking step is shown in FIG. 13 which shows the structure in its final position.

In accordance with the present invention, each of the storeys of the support is prefabricated separately.

Figure 1:
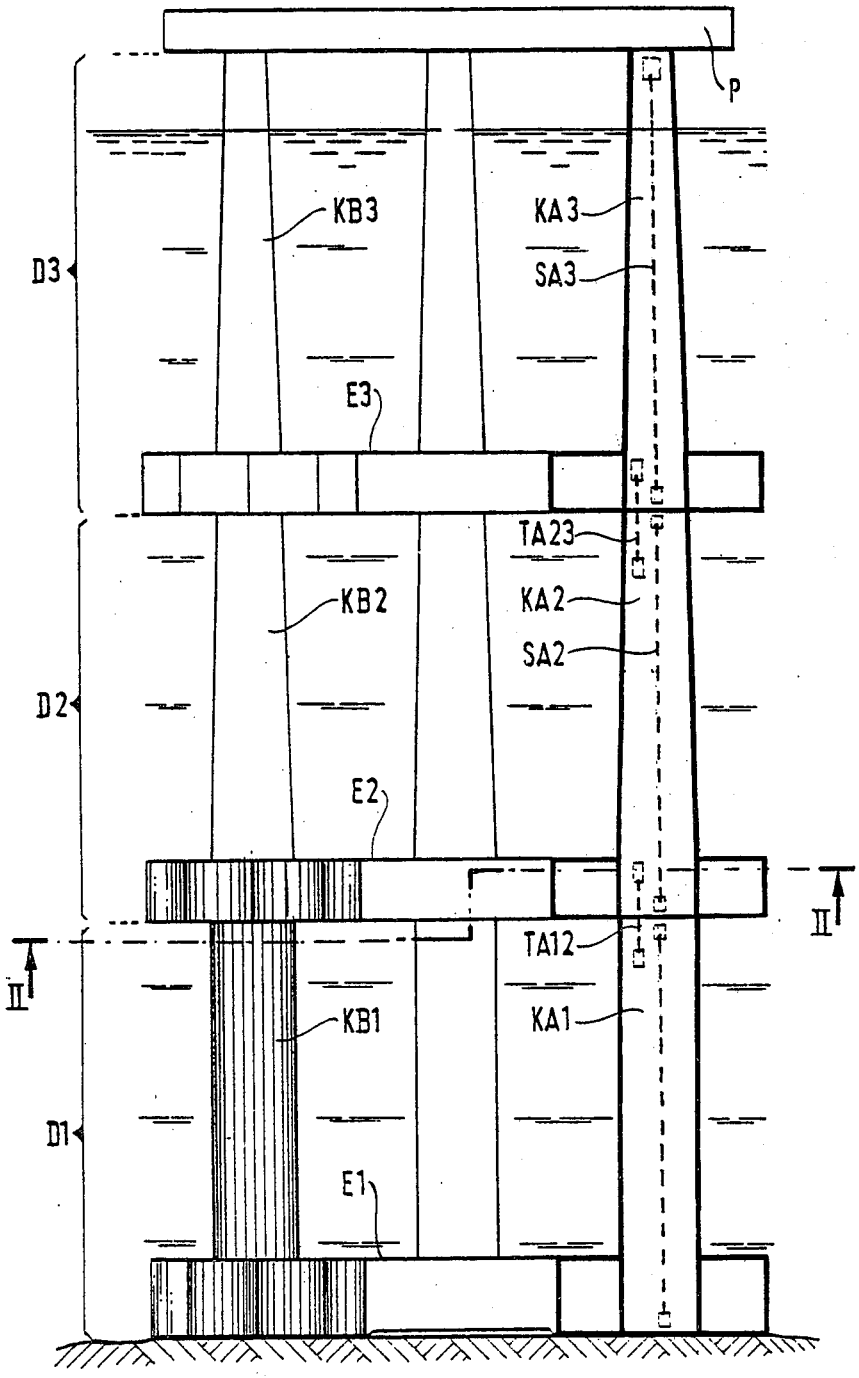
FIG. 1 is a vertical section along line I—I of FIG. 2, and shows a structure built in accordance with the invention.
Figure 2:
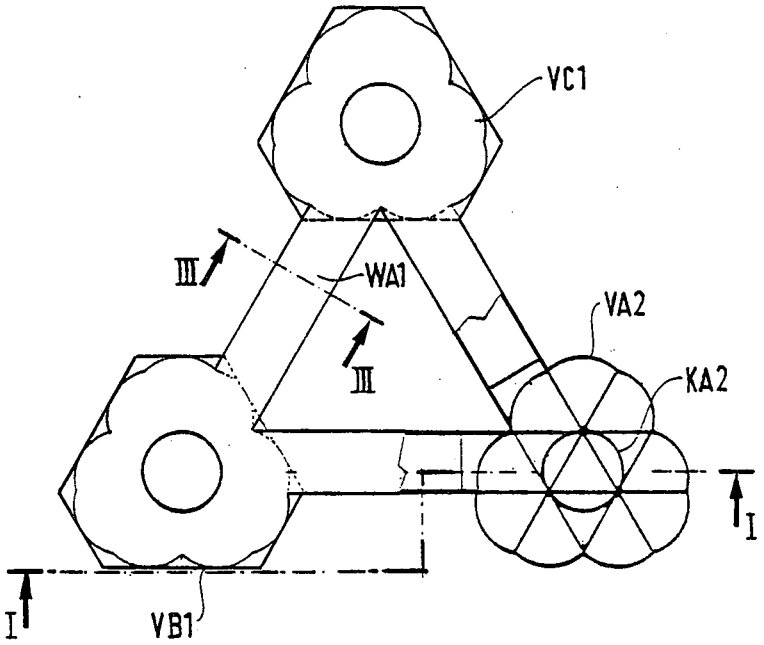
FIG. 2 is a horizontal section along line II—II of the structure shown in FIG. 1.
Figure 3:
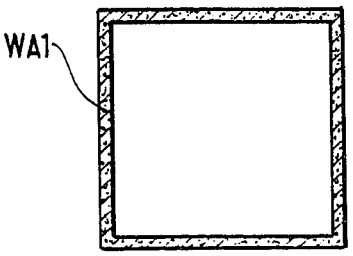
FIG. 3 is a vertical section along line III—III through an arm of a base shown in FIG. 2.
Figure 4:
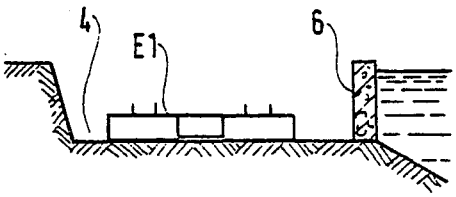
FIGS. 4, 5, 6, *7a*, *7b*, *7c*, 8, 9, 10*a*, 10*b*, 10*c*, 10*d*, 10*e*, 10*f*, 10*g*, 10*h*, 10*i*, 11, 12 and 13 show successive steps during one implementation of the method in accordance with the invention.
Figure 5:
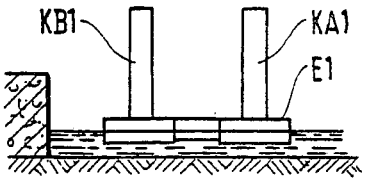

The storeys may be built at different sites or in succession at the same site. In either case, for each storey, the prefabrication step is itself sub-divided as follows:

the base (e.g. E1) is constructed in the horizontal postion in dry dock, i.e. in a basin 4 that is separated from the sea by a gate 6 (see FIG. 4); and the columns are built on the base (see FIG. 5).

The next step is to let water into the basin to float the base (a base that is 20 meters high will need the water to be about 12 to 15 meters deep, see FIG. 5).

Figure 6:
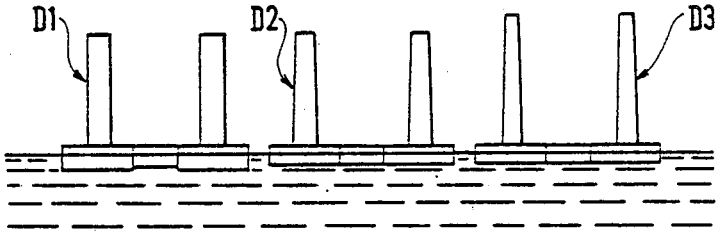

Then all the floating storeys are towed to an assembly site in deeper water near to the construction basin 4 (see FIG. 6).

Figure 7A:
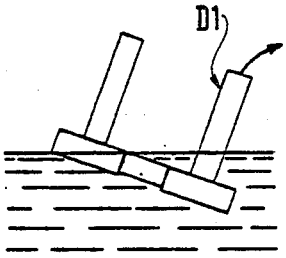
Figure 7B:
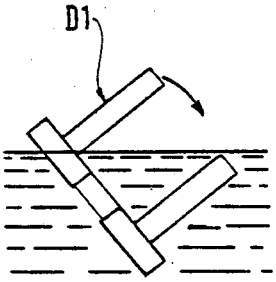
Figure 7C:
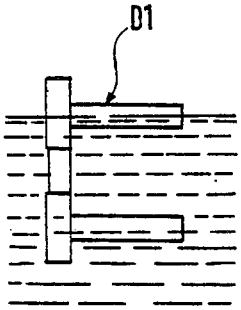

Each storey is tilted over by progressively filling compartments in its base until it is floating with two of its columns at water level and with the third column in the air (see FIGS. 7*a* to 7*c*).

Figure 8:
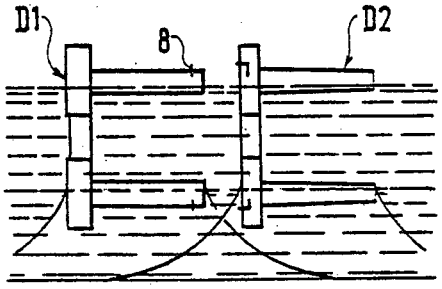
Figure 9:
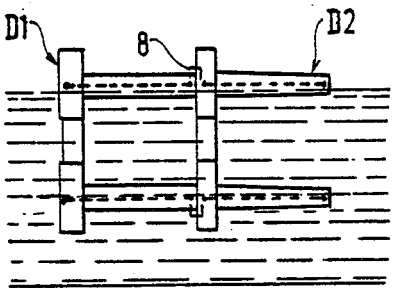

The storeys are then assembled to each other with corresponding columns of the successive storeys being brought into alignment (see FIG. 8), and with the base of each upper storey being assembled to the tops of the columns of the next storey down (see FIG. 9).

It will be understood that the operation of tilting the storeys is performed by suitably controlling the admission and expulsion of water into or out from the compartments, at appropriate moments using water and/or air pumps connected to valves leading to the compartments. The same technique is used for the later steps of rotating the structure during assembly, and for sinking the structure at its point of use.

The assembly step further comprises:

a pre-assembly step in which metal members (8) provided for the purpose in the assembly zones are interconnected (see FIGS. 8 and 9); and a final structure assembly step in which interconnecting prestress cables are installed, put under tension, and embedded in mortar, at least some of said interconnecting cables (TA12, TA23) being longitudinally disposed and extending on either side of the junction plane between two successive storeys beyond the ends of the longitudinal, storey-prestressing cables (SA1, SA2, SA3) in such a manner as to ensure continuous prestressing over the entire height of the structure.

It is often difficult to make proper final connections between storeys using cables such as TA12 and TA23 because the connection zones are under water which both hinders the workmen and increases the risk of subsequent corrosion. It is therefore preferable for the final assembly step itself to comprise a plurality of consecutive partial final assembly steps, with each of said partial final assembly steps comprising final assembly of at least one set (KA) of horizontally aligned columns (KA1, KA2, KA3) that are near enough to the surface of the water for the assembly to take place under favourable conditions. In this context, "near enough to the surace of the water" would ideally be just above the surface so that work takes place out of the water, but not high up in the air. However, underwater working at shallow depths that avoid the need for any special "deep water" diving procedures could well be acceptable, for example to keep the number of rotation operations to a minimum. Thus said final assembly step further includes at least one step of rotating the floating structure between two successive partial final assembly steps, each rotation being about an axis parallel to the columns and being provoked by progressively filling and/or emptying some of the compartments or columns.

Said steps of rotating the structure and of assembling those sets of aligned columns that are sufficiently out of the water are continued until all the sets of columns are assembled.

Figure 10A:
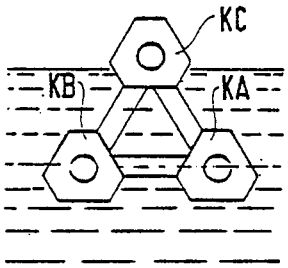
Figure 10B:
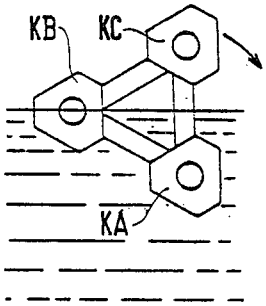
Figure 10C:
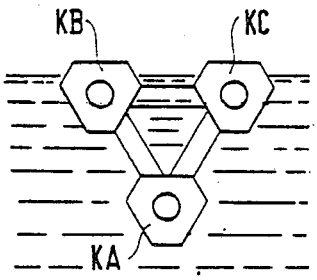
Figure 10D:
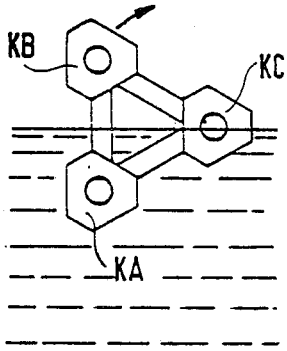
Figure 10E:
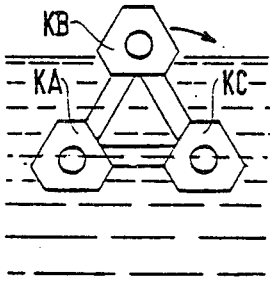
Figure 10F:
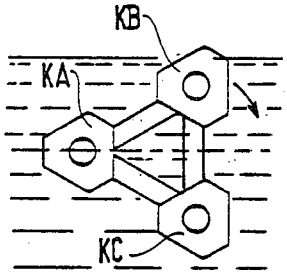
Figure 10G:
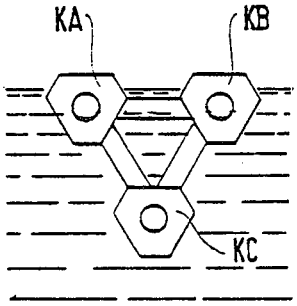

The tilt shown in FIG. 7 is chosen to facilitate preassembly. From the position thus obtained, the structure is rotated as shown in FIGS. 10*a* to 10*g* so that each set of corresponding columns such as KA is brought sufficiently out of the water for the partial final assembly steps to take place under favourable conditions, initially on sets KB and KC (FIG. 10*c*) and then on the set KA (FIG. 10*g*).

Figure 10H:
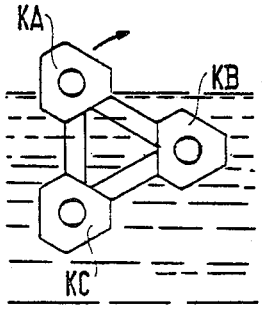
Figure 10I:
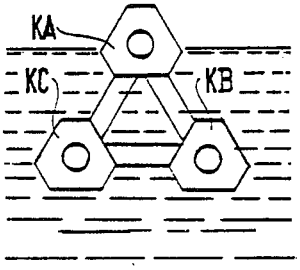

A last rotation step (FIG. 10*h*) brings the structure to the position shown in FIG. 10*i* to facilitate transport through shallow water.

Once the mortar in which the interconnecting cables such as TA12 and TA23 are embedded has hardened, the structure is towed to its final site (FIG. 11).

Figure 12:
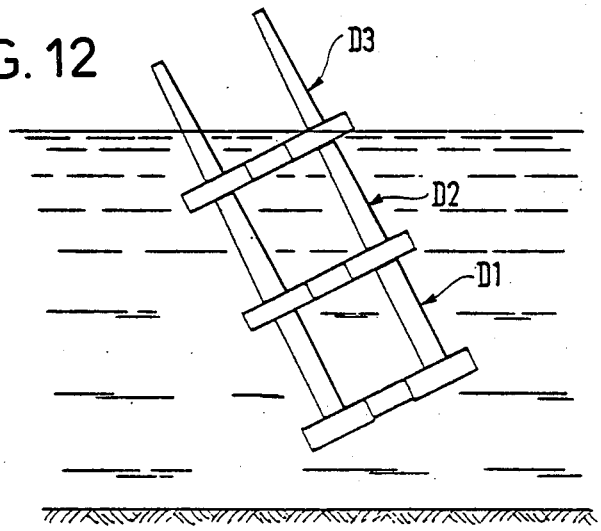

The method then includes a step in which the assembled structure as a whole is tilted to the vertical (see FIG. 12). It is then sunk. During these tilting and sinking steps, once any compartment of the bases is totally immersed for the final time, it is put into direct communication with the sea to equalize pressure.

The structure is finally settled on the sea bed (FIG. 13) by filling both the base compartments and the columns with water. The structure is then ready to receive an above-water working platform P together with oil production equipment, for example. In order to ensure the best possible settling on the sea bed, it is advantageous to inject a filling of cement between the bottom of the bottom base E1 and the sea bed.

I claim:

1. A method of constructing an off-shore concrete structure which stands on the sea floor in depths of more than 200 m and is stabilized thereon by its own weight, the method comprising the following steps:

prefabricating a floating unit comprising a compartmented base with hollow columns projecting upwardly therefrom and floating said unit at a sheltered site by the sea;

transporting said floating unit to a final site at sea; and sinking the unit over its final site by progressively filling the compartments and the columns with water, to cause the base to rest on the sea floor;

the improvement wherein the prefabrication step comprises constructing a succession of units each constituting one storey of the support structure, the succession including at least a bottom storey and a top storey, and each storey comprising a horizontal polygonal compartmented base with vertical hollow columns of equal height disposed at the corners of the base polygon by forming said bases and said columns of concrete reinforced with longitudinal, storey-prestressing cables under tension, said cables being located in the column walls and extending over the full height of each storey;

and wherein the floating and transporting steps comprise:

floating each of the storeys at the prefabrication site;

transporting each storey to an assembly site at sea;

tilting each of the storeys at the assembly site by progressively filling compartments in the base to cause the storey to float with two of its columns at the surface of the water;

assembling the storeys with corresponding columns of successive storeys being aligned, and with the base of each upper storey being assembled to the tops of the columns of the next storey down;

and wherein said assembly step further comprises a preassembly step in which metal members provided for the purpose in the assembly zones are interconnected, and a final structure assembly step in which interconnecting pre-stressed cables are installed, put under tension, and embedded in mortar, at least some of said interconnecting cables being longitudinally disposed and extending on either side of the junction plane between two successive storeys beyond the ends of the longitudinal, storey-prestressing cables in such a manner as to insure continuous pre-stressing over the entire height of the structure; and transporting the structure thus assembled in the horizontal position from the assembly site to the final site;

and tilting the assembled structure to bring it into the vertical before said step of sinking it.

2. A method according to claim 1, wherein the final assembly step itself comprises a plurality of consecutive partial final assembly steps, each of said partial final assembly steps comprising final assembly of at least one set of horizontally aligned columns that are out of the water or are at shallow depths, said final assembly step further including at least one step of rotating the floating structure between two successive partial final assembly steps, each rotation being about an axis parallel to the columns and being provoked by progressively filling and/or emptying some of the compartments or columns;

said steps of rotating the structure and of assembling suitably placed sets of aligned columns being continued until all the sets of columns are finally assembled.

* * * * *